US005778451A

United States Patent [19]

Rhea

[11] Patent Number: 5,778,451

[45] Date of Patent: Jul. 14, 1998

[54] BUOYANT SWIM GARMENT AND METHOD OF MANUFACTURE

[76] Inventor: Richard L. Rhea, 1872 Woodhollow Dr., Apt. 209, St. Louis, Mo. 63043

[21] Appl. No.: 792,984

[22] Filed: Feb. 3, 1997

[51] Int. Cl.[6] ..... A41D 7/00; B36C 9/08

[52] U.S. Cl. ..... 2/67; 2/267; 441/88; 441/106; 441/115; 441/120

[58] Field of Search ..... 2/267, 67, 69, 2/69.5, 94, 79, 227, 403, 404, 455, 456, 464, 465; 441/88, 106, 107, 108, 109, 110, 111, 112, 113, 114, 115, 116, 117, 118, 119, 120, 121, 122, 123, 124, 125

[56] References Cited

U.S. PATENT DOCUMENTS

| | | | |
|---|---|---|---|
| D. 272,010 | 1/1984 | Rhea . | |
| D. 333,903 | 3/1993 | Meredith . | |
| 960,129 | 5/1910 | Wilkinson et al. | 2/67 |
| 1,301,831 | 4/1919 | Gain | 441/115 |
| 1,522,842 | 1/1925 | Sladdin | 2/267 |
| 1,985,568 | 12/1934 | Hall | 441/115 |
| 2,331,302 | 10/1943 | Brown | 441/110 |
| 2,719,301 | 10/1955 | Witkower | 2/267 |
| 2,802,222 | 8/1957 | Chapman | 441/113 |
| 4,291,427 | 9/1981 | Rhea . | |
| 4,847,913 | 7/1989 | Chen | 2/464 |
| 5,013,271 | 5/1991 | Bartlett | 441/115 |
| 5,459,874 | 10/1995 | Meredith . | |
| 5,516,320 | 5/1996 | LaPlant | 441/113 |

FOREIGN PATENT DOCUMENTS

| | | | |
|---|---|---|---|
| 992764 | 5/1965 | United Kingdom | 2/67 |
| 1212756 | 11/1970 | United Kingdom | 441/107 |

*Primary Examiner*—Jeanette E. Chapman

*Attorney, Agent, or Firm*—Polster, Lieder, Woodruff & Lucchesi, L.C.

[57] ABSTRACT

A buoyant swim garment has inner and outer layers of fabric and, intermediate the inner and outer layers a buoyant flexible sheet material. The sheet material has spaced V-shaped grooves with sides meeting in a line at an apex, the grooves extending in a height-wise dimension of the garment to define panels. The periphery of the material has a bevel with a thin, pliant outer edge. Stitching extends through the apex of the V-shaped grooves and the inner and outer layers of fabric. In manufacturing the garment, the V-shaped grooves are skived, and the periphery of the sheet material is also skived to form the bevel. In one embodiment, the grooves face the inner layer of fabric, and the beveled periphery faces the outer layer.

13 Claims, 4 Drawing Sheets

BUOYANT SWIM GARMENT AND METHOD OF MANUFACTURE

BACKGROUND OF THE INVENTION

Applicant is the patentee of U.S. Pat. No. 4,291,427. Since 1981 when that patent issued, a number of other patents have issued for various types of floatation garments. The present invention relates to swim garments with buoyancy, but not to garments intended to act as life jackets.

A description of much of the prior art is to be found in U.S. Pat. No. 5,459,874.

One of the objects of this invention is to provide a buoyant garment that aides the user in staying afloat, but does not interfere with the free movement of the user in swimming or aquatic sports or games.

Another object is to provide such a garment that is attractive in appearance and not bulky.

Other objects will become apparent to those skilled in the art in the light of the following disclosure and accompanying drawing.

BRIEF SUMMARY OF THE INVENTION

In accordance with this invention, generally stated, a buoyant swim garment is provided. The garment has a circumferential region, a heightwise dimension, inner and outer layers of fabric, and, intermediate the inner and outer layers, buoyant, flexible sheet material. The sheet material has two broad surfaces, a plurality of panels and a periphery. V-shaped grooves are formed in one of the broad surfaces, with sides meeting at a line in an apex closely adjacent the other of the two broad sides. The grooves extend in the heightwise dimension of the garment to define the panels. The periphery of the sheet material has a bevel with a thin, pliant outer edge. Stitching extends through the apex of the V-shaped grooves and the inner and outer fabric layers. In making the garment, the V-shaped grooves are skived into the sheet material to form plane surfaces meeting in a line at an apex, and the periphery of the material is skived to form the bevel with the pliant outer edge.

In one embodiment, the V-shaped grooves and the beveled edge face the outer fabric layer. In another embodiment, the V-shaped grooves face the inner layer and the beveled edge, the outer layer.

The sheet material may be in two or more separate sections, with the V-shaped grooves defining a plurality of panels in each one.

The construction of the suit of this invention is simpler than the garments of U.S. Pat. No. 5,459,874, for example, in that the section or sections of the buoyant sheet can simply be sandwiched between the two layers of the fabric and stitched in place, whereas as is explained in U.S. Pat. No. 5,459,874, when pockets are provided for blocks of floatation material, it is necessary to form individual pockets and there is some difficulty in inserting the blocks, for which purpose a special tool is described in that reference.

DETAILED DESCRIPTION OF THE INVENTION

Figure 1A:
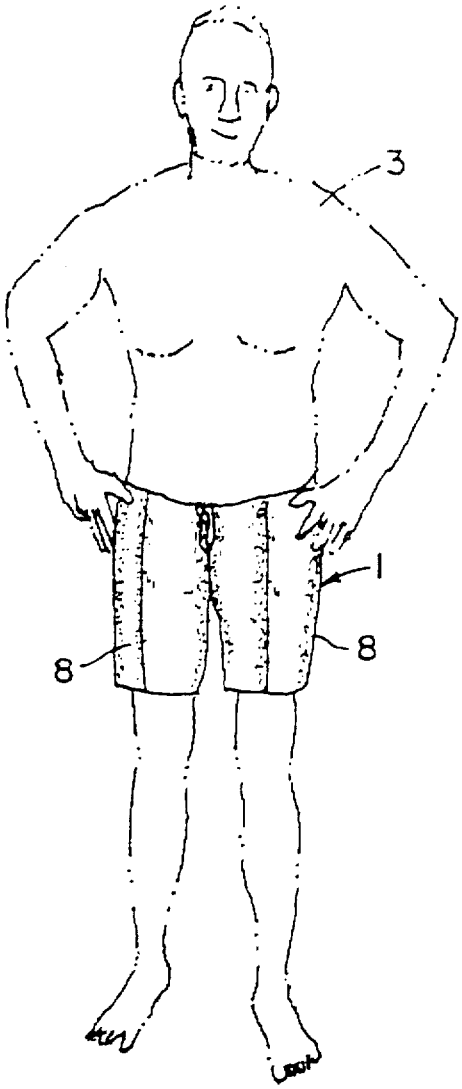
FIG. 1A is a view in front elevation of one embodiment of flotation garment, in this case trunks worn by a man.
Figure 1B:
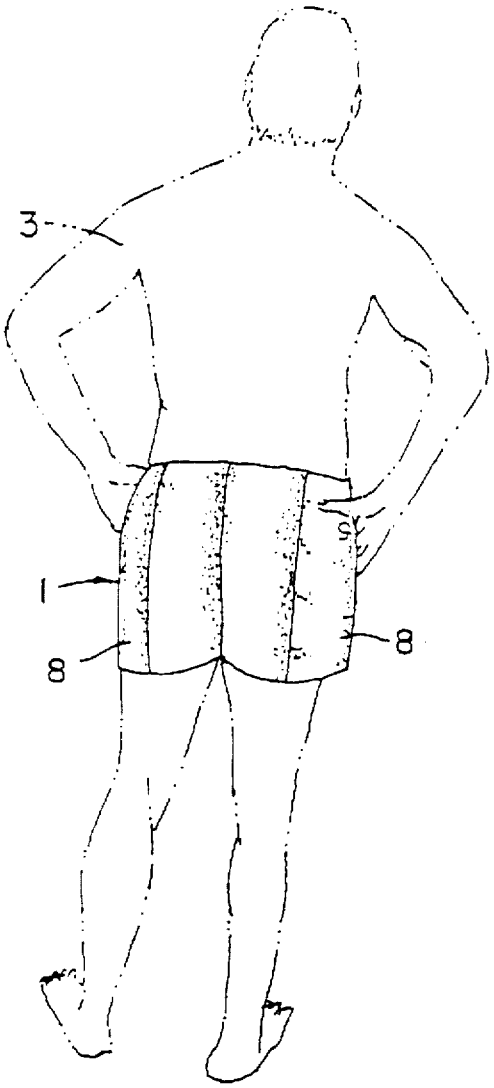
FIG. 1B is a view in rear elevation of the device shown at FIG. 1A.
Figure 2:
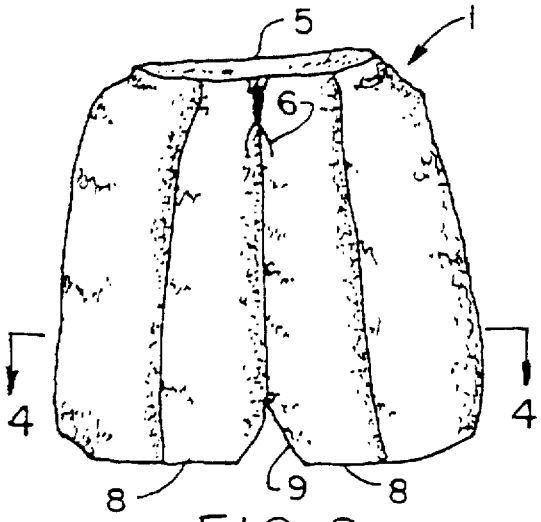
FIG. 2 is a somewhat enlarged view in front elevation of the trunks shown in FIGS. 1A and 1B.
Figure 3:
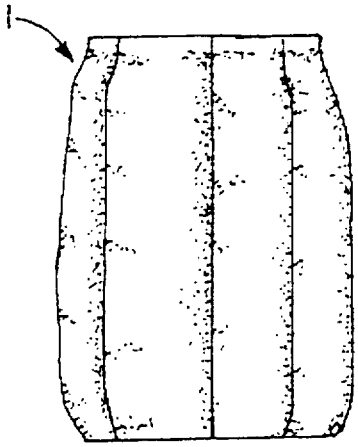
FIG. 3 is a view in side elevation.

Referring now to FIGS. 1 through 4 for one illustrative embodiment, a garment 1 in this illustration is shown as a man's trunks being worn by a man 3. The garment has a circumferential reach 5 about it's upper edge, and, in the illustration, a draw string 6, although other means for supporting the trunks, such as elastic and the like can be used. The garment has legs 8 and a crotch section 9, all of these elements being conventional, as illustrated in the patents cited above.

The garment 1 is made up of an inner layer of fabric 10, an outer layer of fabric 12, and an intermediate sheet 15 of buoyant flexible material, such as a closed cell expanded or foamed polyvinyl chloride. The sheet 15 has an outside broad flat face 16 on one side and a similar, inside broad flat face 18 on the other. In the illustrative embodiment shown, the sheet 15 is made in two sections 17 and 19. Each of the sections 17 and 19 is divided in the heightwise dimension of the garment into panels. In the illustrative embodiments shown, each of the sections 17 and 19 is divided into four panels, two inboard panels 21 and two outboard panels 22. Each of the sections 17 and 19 has a periphery 20, and in the embodiment shown in which two sections are employed, a crotch notch 25, on inboard lower edges of the inboard panels 21.

The sections 17 and 19 are skived to form V-shaped grooves 27 extending in the height wise dimension of the garment. The V-shaped grooves have planer side surfaces 28 which meet in an apex line 29.

Figure 5:
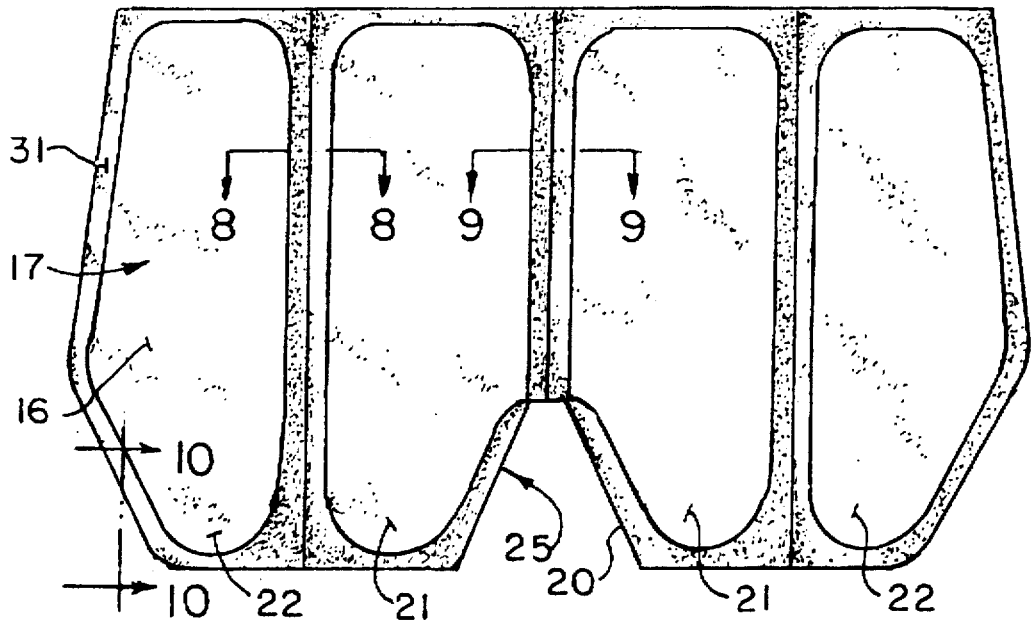
FIG. 5 is a view in front elevation of a section of buoyant flexible sheet material used in the construction of the garment shown in FIGS. 1 through 4 before its assembly into the garment.
Figure 6:
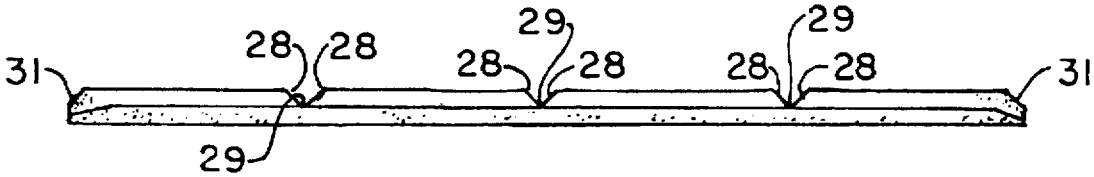
FIG. 6 is an edge view in the direction from top to bottom of FIG. 5.
Figure 7:
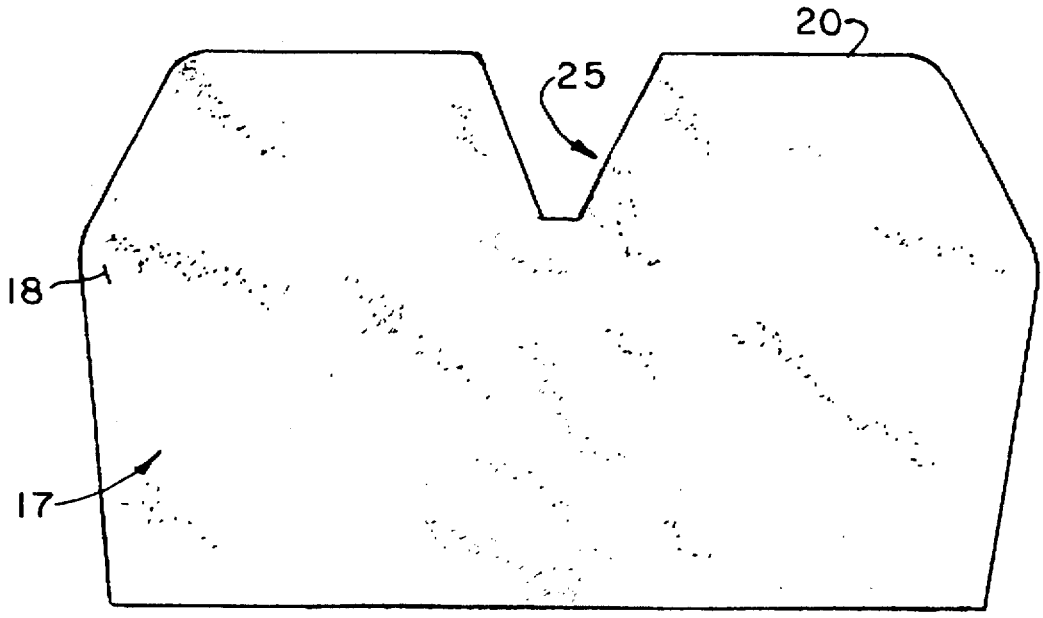
FIG. 7 is a view in rear elevation of the sheet section shown in FIG. 5.

In the embodiment shown in FIGS. 5–7, the V-shaped grooves are skived in the outside broad face 16.

In the embodiment shown in FIGS. 5–7 a beveled perimetric edge 31 is skived through the entire periphery of each section, on the same outside broad face 16, which faces the outer fabric layer 11.

Figure 4:
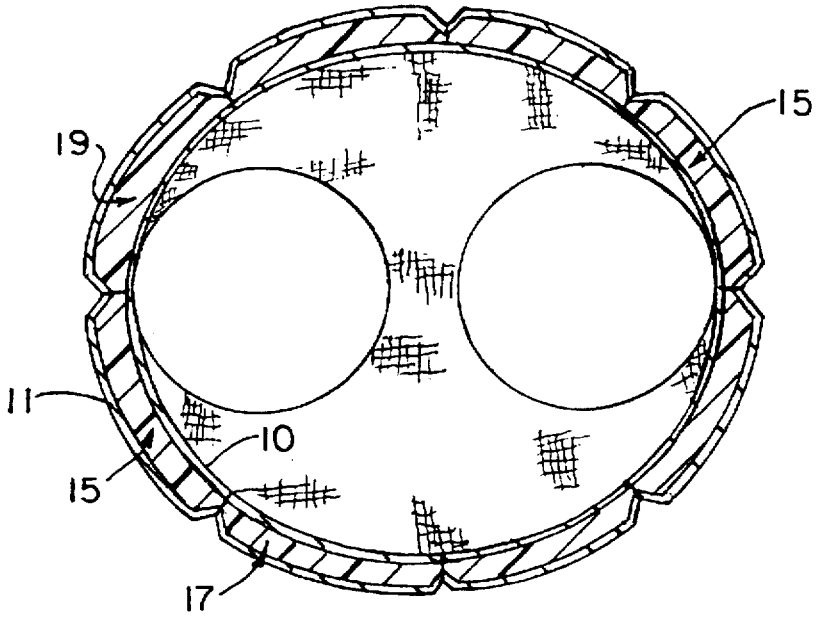
FIG. 4 is a sectional view taken along the line 4—4 of FIG. 2.
Figure 8:
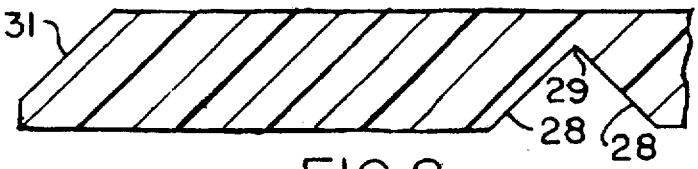
FIG. 8 is an enlarged sectional view taken along the line 8—8 of FIG. 5.
Figure 10:
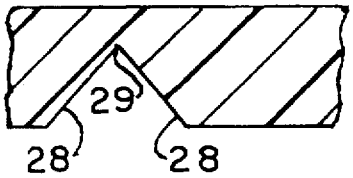
FIG. 10 is an edge view taken along the line 10—10 of FIG. 5.
Figure 10:
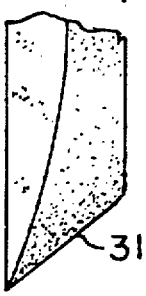
Figure 9A:
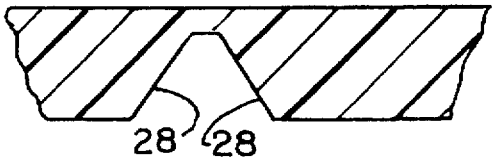
FIG. 9*a* is a sectional view taken along the line 9—9 of FIG. 5.

Lines of stitching 10 extend the length of the apex line 29, through the outer layer 11, the flexible sheet 15 and the inner layer 10, except at the ends of the sections where they meet, when the stitching goes through the outer and inner layers, but outboard of and along the beveled meeting edges of the sections, as shown in FIG. 4.

Figure 11:
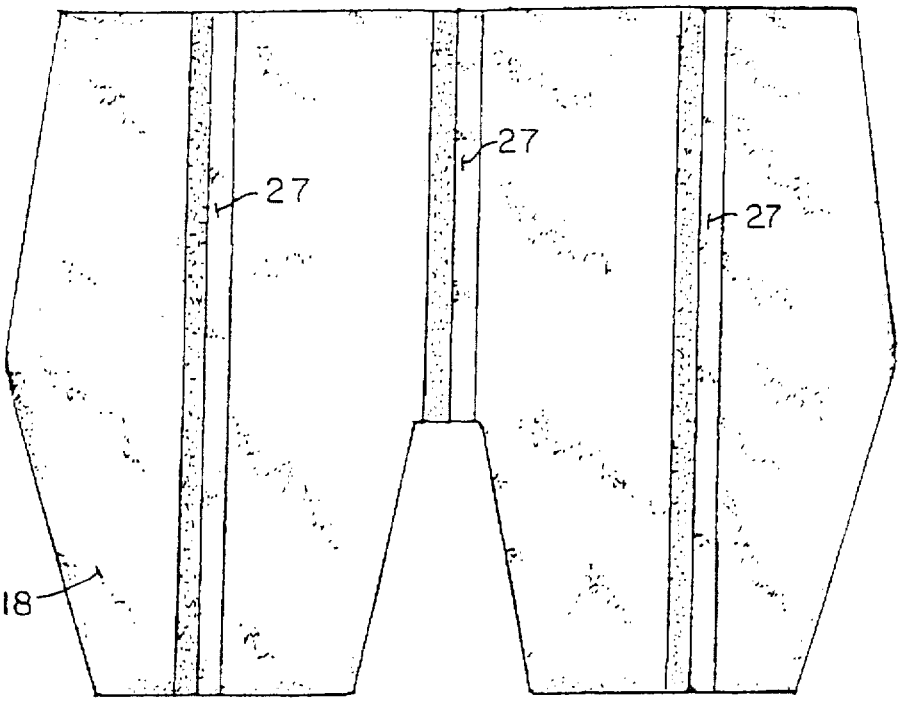
FIG. 11 is a view in front elevation of another embodiment of flexible buoyant sheet section.
Figure 12:
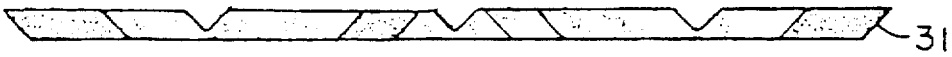
FIG. 12 is a view in edge elevation in the direction from bottom to top of the sheet section shown in FIG. 11.
Figure 13:
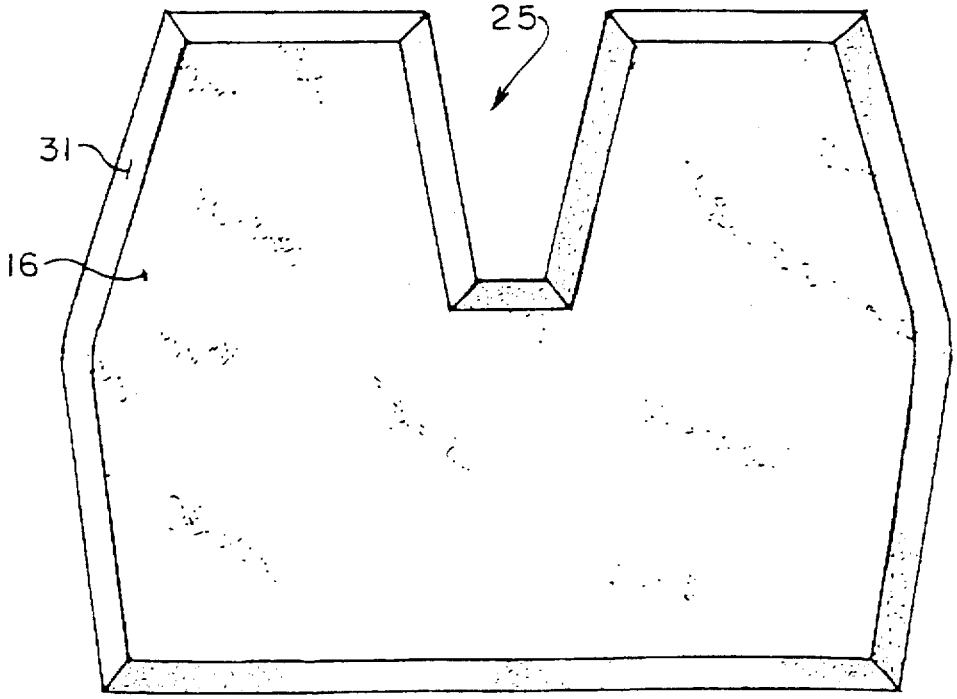
FIG. 13 is a view in rear elevation of the sheet section shown in FIG. 11.

In a second embodiment, FIGS. 11–13, the grooves 27 are formed in the side broad surface 18 of the sheet, while the beveled perimetric peripheral edge is formed on the outside surface 16. In this embodiment, the ungrooved outside surface 1 is contiguous and faces the outer layer 11 of fabric, presenting, therefore, a smooth, unindented surface to the garment, the panels being identified only by the rows of stitching in the finished garment, as distinguished from the grooves as shown in FIG. 4.

In manufacturing the garment of this invention, the sections are skived with a skiving knife or machine, to form the grooves 27, and the edges of the sections are skived to form the bevels 31.

The grooves 27 are cut to within no more than about ⅛ of an inch from the opposite surface, preferably on the order of the 16th of an inch, and the beveled edges are skived either to a line or at least are not more than ⅛ of an inch thick.

The sections are simply laid on top of one of the fabric layers, the other of the fabric layers is laid on top of the sections, and the lines of stitching are made down the apex lines of the grooves. The fabric layers are made longer than the sheet, so that they can be stitched together between the free ends of the sheet or sections. To this end, a line of stitching can be run down along the free edges of each section, and the free edges of the fabric layers can be hemmed or bound and joined in any conventional way. They can be joined immediately adjacent the edges of the sections, as shown in FIG. 4, or they can define a gap between the adjoining sections.

The style of the garment made with sections shown in FIG. 5 differs from the garment made with the sections shown in FIG. 11 in that the height to width proportions of FIG. 5 are less than those shown in FIG. 11. The latter is the more popular style at the moment. The same grooving can be applied to either style.

An advantage of the skiving over molding the grooves and edge bevels is that the cell structure of the foamed material is not affected, which makes the skived edges and apex lines more pliant and flexible, permitting the garment to conform more closely to the body and the beveled edges, soft.

Numerous variations in the construction of the garment of this invention will occur to those skilled in the art in the light of the foregoing disclosure. For example, different sheet material can be used, as long as it is flexible and buoyant. The "fabric" of the inner and outer layers can be, and preferably is, a cloth fabric, but it can be any suitable thin sheet material. A cup can be provided in the crotch of the garment. Other means of supporting the garment at the waist can be provided. Strips of hook and loop material can be sewn on and around the garment at the waist, facing inwardly, to permit the garment to be held closed to facilitate storage. A greater number of panels can be formed, and stitching need not be run down all of the grooves defining the panels. The greater number of panels will decrease the buoyancy by the amount of material cut away to define them, but will make the garment move conformable to the body. For children's and women's one piece suits, panels can be extended above the waist and made thinner by virtue of the greater volume of buoyant material provided. These are merely illustrative.

I claim:

1. The process of making a buoyant swim garment having a circumferential reach and a heightwise dimension, said garment having inner and outer layers of fabric and, intermediate said inner and outer layers, a buoyant flexible sheet material, said sheet material having two broad side surfaces, a plurality of panels and a perimeter, said process comprising skiving in one of said side surfaces of said sheet material spaced V-shaped grooves extending in the heightwise dimension of said garment to define said panels, and skiving the periphery of said material to form a bevel with a pliant outer edge, positioning said skived material between said inner and outer layers with said bevel facing said outer layer, and stitching through an apex of said V-shaped grooves and said inner and outer layers.

2. The process of claim 1 wherein said V-shaped grooves open toward said inner layer, and said peripheral bevel faces said outer layer.

3. The process of claim 1 including the step of forming a crotch notch and skiving edges defining said crotch notch.

4. The process of claim 1 wherein said flexible sheet material is in at least two sections.

5. The process of claim 2 wherein said flexible sheet material is in at least two sections.

6. The process of claim 3 wherein said sheet material is in at least two sections, and said crotch notch is formed in two sections on opposite sides of said circumferential reach of said garment.

7. A buoyant swim garment having a circumferential reach and a heightwise dimension, said garment having inner and outer layers of fabric and, intermediate said inner and outer layers, a buoyant flexible sheet material, said sheet material having two broad surfaces, a plurality of panels and a periphery, said sheet material having spaced V-shaped grooves in one of said broad surfaces, with sides meeting in a line at an apex closely adjacent the other of said two broad sides, said grooves extending in the heightwise dimension of said garment to define said panels, the periphery of said material having a bevel with a thin, pliant outer edge, and stitching extending through said apex of said V-shaped grooves and said inner and outer layers, an open mouth of said grooves facing said inner layer and said peripheral bevel facing said outer layer.

8. A buoyant swim garment having a circumferential reach and a heightwise dimension, said garment having inner and outer layers of fabric and, intermediate said inner and outer layers, a buoyant flexible sheet material, said sheet material having two broad surfaces, a plurality of panels and a periphery, said sheet material having spaced V-shaped grooves in one of said broad surfaces, with sides meeting in a line at an apex closely adjacent the other of said two broad sides, said grooves extending in the heightwise dimension of said garment to define said panels, the periphery of said material having a bevel with a thin, pliant outer edge, and stitching extending through said apex of said V-shaped grooves and said inner and outer layers the thickness of said material at said apex being no more than about ⅛".

9. The garment of claim 8 wherein said buoyant sheet material comprises a plurality of sections, each with a plurality of panels.

10. The garment of claim 8 wherein an open mouth of said grooves faces said inner layer and said peripheral bevel faces said outer layer.

11. The garment of claim 8 wherein the thin, pliant, outer edge of said sheet material is no more than about ⅛" thick.

12. A buoyant swim garment having a circumferential reach and a heightwise dimension, said garment having inner and outer layers of fabric and, intermediate said inner and outer layers, a buoyant flexible sheet material, said sheet material having two broad surfaces, a plurality of panels and a periphery, said sheet material having spaced V-shaped grooves in one of said broad surfaces, with sides meeting in a line at an apex closely adjacent the other of said two broad sides, said grooves extending in the heightwise dimension of said garment to define said panels, the periphery of said material having a bevel with a thin, pliant outer edge, and stitching extending through said apex of said V-shaped grooves and said inner and outer layers, said garment including a crotch notch in a lower edge of said buoyant sheet material, edges defining said notch being beveled.

13. The garment of claim 12 wherein said buoyant sheet material comprises a plurality of sections, each with a plurality of panels and wherein a crotch notch is provided in both of two sections opposite one another with respect to said circumferential reach, each of said crotch notches having beveled edges.

* * * * *